United States Patent [19]

Avila et al.

[11] Patent Number: 4,604,930

[45] Date of Patent: Aug. 12, 1986

[54] PUNCH PRESS

[76] Inventors: Robert M. Avila, 8362 Seaport Dr., San Clemente, 92764; Glenn A. Hoffman, Jr., Huntington Beach, both of Calif.

[21] Appl. No.: 605,636

[22] Filed: Apr. 30, 1984

[51] Int. Cl.[4] ..... B26D 5/12

[52] U.S. Cl. ..... 83/527; 83/588; 83/637; 83/639; 100/257

[58] Field of Search ..... 100/266, 257; 83/637, 83/639, 588, 590, 527, 530; 308/4 C; 72/453.09, 453.12, 456

[56] References Cited

U.S. PATENT DOCUMENTS

| | | | |
|---|---|---|---|
| 2,608,253 | 8/1952 | Battles et al. | 100/257 |
| 2,816,608 | 12/1957 | Farmwald et al. | 164/95 |
| 3,324,704 | 6/1967 | Savory | 72/453.09 |
| 3,472,109 | 10/1969 | Haas | 83/590 X |
| 3,532,016 | 10/1970 | Lane | 83/637 X |
| 3,590,677 | 7/1971 | Smith | 83/454 |
| 3,668,919 | 6/1972 | Hongo | 83/639 X |
| 3,822,627 | 7/1974 | Bianchi | 83/639 X |
| 3,913,438 | 10/1975 | Walters et al. | 83/529 |
| 3,915,044 | 10/1975 | Bley | 83/639 |
| 4,082,026 | 4/1978 | Miyazaki | 83/453 |
| 4,195,565 | 4/1980 | Cordeiro | 100/266 |
| 4,249,436 | 2/1981 | Clay | 83/100 |

FOREIGN PATENT DOCUMENTS

| | | | |
|---|---|---|---|
| 2106646 | 5/1972 | Fed. Rep. of Germany | 83/637 |
| 1137914 | 1/1957 | France | 100/266 |
| 297493 | 6/1954 | Switzerland | 100/266 |

*Primary Examiner*—James M. Meister

*Attorney, Agent, or Firm*—Gausewitz, Garr & Rothenberg

[57] ABSTRACT

A light-weight press for punching, forming, etc., in which the guide pins are bored in order that pull rods may be passed therethrough from actuating cylinders to an adjustment mechanism that interrelates the upper ends of the guide pins with the platen of the press. The adjustment mechanism are connected to each other so as to operate simultaneously and ensure that the forces in the press do not become unbalanced. Downward movement of the platen is limited by striking of the upper ends of the guide pins by stop elements associated with the pull rods.

8 Claims, 2 Drawing Figures

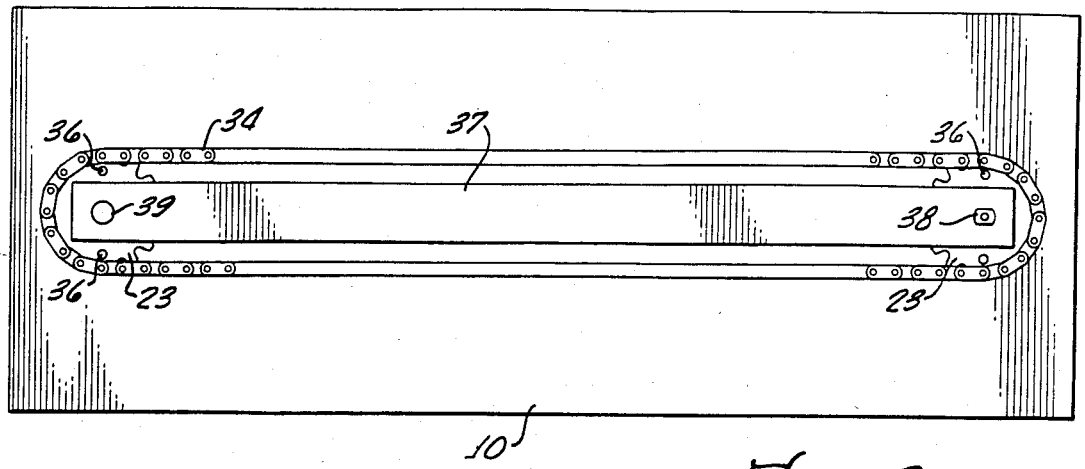
FIG. 2.
FIG. 1.
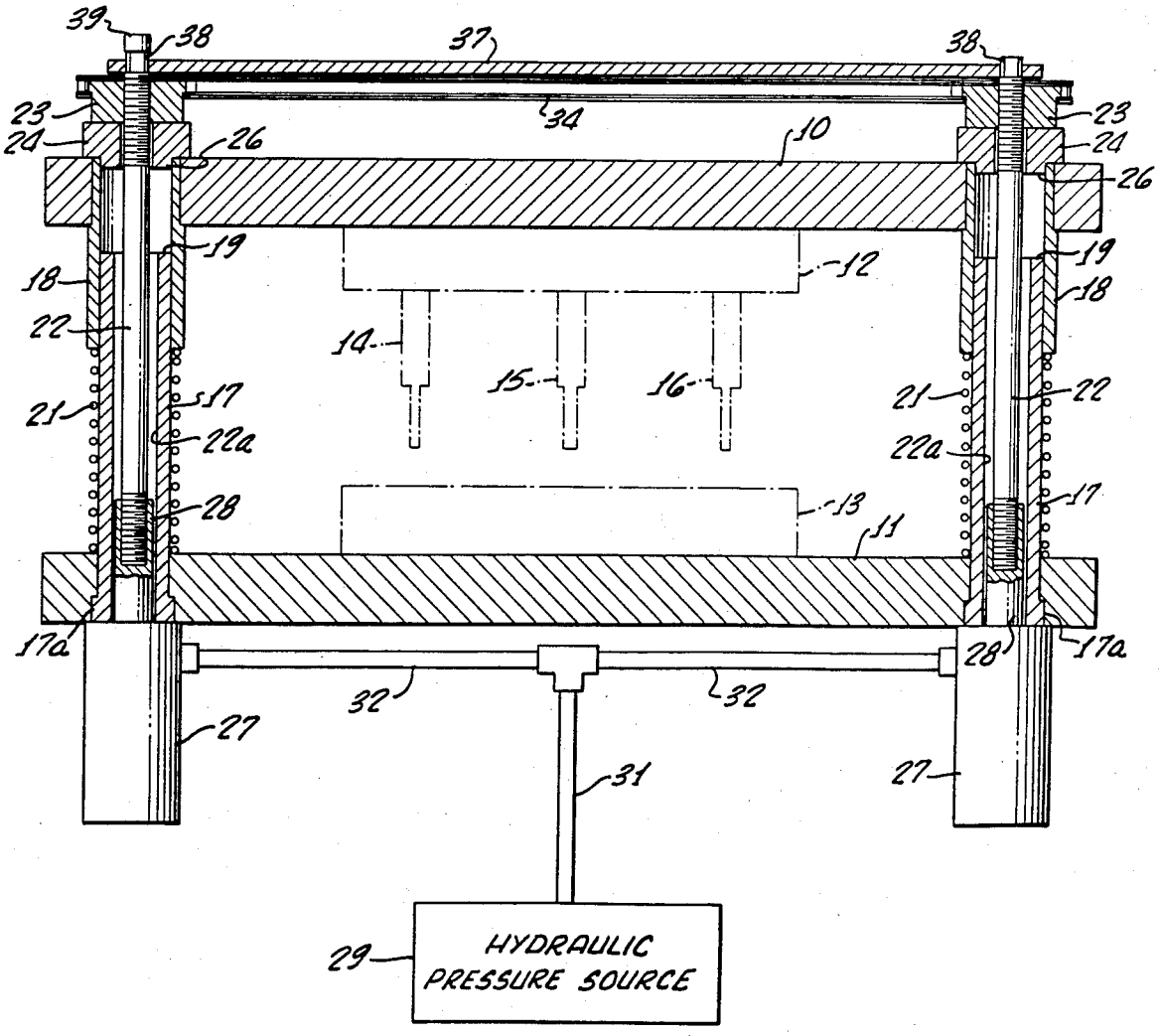

PUNCH PRESS

BACKGROUND OF THE INVENTION

There have been various attempts to create small-size, light-weight, inexpensive, quiet, portable punch presses that are practical and economical to manufacture, use and maintain. Such attempts have been, in large part, failures. The reasons for the failures have included lack of sufficient tonnage, lack of balance, excessive numbers of parts (especially, parts that need to be specially made and/or require large seals), inability to adjust, inability to use with different sets of dies, etc.

Furthermore, the prior-art presses of the type indicated have sometimes involved movable large-diameter rods, instead of the fixed or stationary guide pins that workers in the art are accustomed to.

Very importantly, the adjustability of prior-art presses has been either excessively expensive and impractical or has permitted inequality, the latter resulting in off-balance forces that can be destructive or create excessive wear.

SUMMARY OF THE INVENTION

Applicants have invented a new type of press of the class indicated, in which forces are transmitted through stationary guide pins. Furthermore, adjustable means that operate in unison are provided to create fine adjustments of the platen of the press, thus not only permitting adjustments for different dies, but ensuring that the forces will always be balanced. Balanced forces are also assured by the provision of a single source of fluid, such source being connected to corresponding cylinders that are mounted at the lower ends of the guide pins and serve to operate pull rods extended through the pins.

The stop means limiting downward movement of the platen is on the guide pins.

In accordance with the method, small and economical cylinders are mounted at the lower ends of stationary, vertical guide pins, and supplied with fluid. When operated, the cylinders transmit forces through the guide pins, to shift the platen downwardly. The method also comprises connecting adjustment means to each other to assure simultaneous adjustment in exactly the same amounts. The method further comprises stopping platen movement by the guide pins.

BRIEF DESCRIPTION OF THE DRAWINGS

FIG. 1 is a vertical sectional view showing a fully-open punch press incorporating the present invention, but with the housing omitted; and FIG. 2 is a top plan view of the showing of FIG. 1.

DETAILED DESCRIPTION OF THE PREFERRED EMBODIMENT

The word "punch press", as employed in the present specification and claims, relates to a press which will not only effect punching, but forming of metal parts, braking, and other related operations.

The press is illustrated to comprise strong metal plates mounted in parallel relationship, and numbered, respectively, 10 and 11. Upper plate 10 is termed the platen, while lower plate 11 is termed the bed.

It is a feature of the present press that many types of metal-punching, metal-forming or metal bending dies may be mounted, respectively, to plates 10 and 11, just as in the case relative to a large and expensive press. In FIG. 1, there is represented an upper die 12 mounted to the underside of platen 10, and a lower die 13 mounted on the upper side of bed 11. In the example, upper die 12 includes three punches 14-16 adapted to cooperate with corresponding holes (not shown) in lower die 13 in order to punch metal.

The bed 11 is mounted on any suitable support (not shown, because the support does not contribute to the strength of the press). As an example, a sheetmetal housing, and a suitable angle-iron frame, may provide the support for bed 11.

Mounted fixedly in bed 11, and projecting vertically-upwardly therefrom, are guide pins 17. Preferably, each pin 17 is press-fit upwardly through openings in bed 11, there being a flange **17*a* at the lower end of each pin to limit the degree of pressing movement. Flange 17*a* fits into a corresponding counterbore in the associated guide-pin opening in bed 11**.

Bushings 18 are mounted slidably on guide pins 17 at the upper ends thereof, and extend upwardly above the extreme upper end surfaces 19 of the guide pins. As shown, the bushings have necked-down upper end portions which extend upwardly through openings in platen 10, and terminate at the same plane as the upper surface of platen 10.

Helical compression springs 21 are mounted around the guide pins 17 and seated between the upper surface of bed 11 and lower ends of bushings 18. The springs 21 maintain bushings 18, and thus platen 10, pushed upwardly as far as permitted by mechanisms next described.

The guide pins 17 are longitudinally bored at **22*a* to receive pull rods 22 formed of high-strength steel. The upper ends of pull rods 22 are threaded, and are threadedly associated with sprocket gears 23. The lower surfaces of the hubs of gears 23 seat on combination spacer and stop elements 24, each such element 24 having formed thereon a downwardly-extending neck portion 26 that fits into the upper end of the associated bushing 18**, and performs a centering function.

Hydraulic cylinders 27 are disposed immediately beneath the lower ends of guide pins 17, but need not be connected to the guide pins or to the bed 11. The piston rods of cylinders 27 are numbered 28, and extend upwardly from the pistons (not shown) into the lower portions of the longitudinal bores **22*a* in pins 17. The upper ends of the piston rods 28 are threadedly connected, or otherwise suitably connected, to the lower ends of pull rods 22**.

The hydraulic cylinders 27 are identical to each other, and their piston rods 28 are pulled upwardly—by springs 21—as far as permitted by the internal construction of cylinders 27, at all times except when hydraulic fluid is injected into cylinders 27 from a suitable source 29 of hydraulic pressure.

When hydraulic pressure is applied, fluid flows through pipes or conduits 31 and 32 to cylinders 27, thus forcing down the pistons (not shown) therein. The associated piston rods 28 and pull rods 22 are then pulled downwardly, while the casings of cylinders 27 are forced upwardly. When hydraulic pressure is not applied, the springs 21 push bushings 18 and platen 10 upwardly, which in turn lifts spacers 24 and gears 23, and this operates through pull rods 22 to lift piston rods 28 and thereby expel hydraulic fluid from cylinders 27 into pipes or conduits 32.

It is emphasized that the downward movement of platen 10 is stopped by the upper end surfaces 19 of guide pins 17, such surfaces being engaged by the lower surfaces of neck portions 26 of elements 24. Thus, to summarize, downward platen movement is stopped by the guide pins, while upward platen movement is stopped by engagement of the pistons, in cylinders 27, with upper-internal stop portions of such cylinders.

The outer diameters of the housings of cylinders 27 are larger than are the outer diameters of flanges 17*a* at the lower ends of guide pins 17. The cylinders 27 seat on the underside of the bed 11 and cannot move upwardly despite the large pressures generated by the hydraulic fluid.

It is to be understood that the hydraulic pressure source may be replaced by an air pressure source, but this lowers the amount of force generated by the press. In the presently-preferred embodiment, the hydraulic pressure source is energized by an air pressure source, there being an air tank which operates to energize a relatively large-diameter air cylinder, and such cylinder in turn operates to exert pressure on hydraulic fluid that is employed to actuate the hydraulic cylinders 27.

Because the hydraulic cylinders 27 are identical, and because they are supplied with hydraulic fluid from a common source, equal forces are transmitted to pull rods 22 to maintain a balanced pressure relationship in the press. There will next be described how the platen 10 is vertically adjusted relative to guide pins 17, to thus permit the spacing between platen 10 and bed 11 to be varied in accordance with the requirements of the particular tooling employed. Very importantly, this variation is effected uniformly, so that the platen does not become tilted or cocked.

The gears 23 are so mounted on the upper threaded portions of pull rods 22—when the platen 10 is in its uppermost postion permitted by cylinders 27, piston rods 28 and pull rods 22—that the platen 10 is substantially perfectly parallel to bed 11. Platen 10 is also substantially perfectly perpendicular to the vertical guide pins 17 which project perpendicularly from bed 11.

A chain 34 is meshed with the sprocket portions of both of gears 23, thus ensuring that both gears 23 will rotate in unison with each other when a height adjustment is desired. As shown at the left portion of FIG. 2, there are holes 36 to receive a spanner wrench, such wrench being employed to rotate the left gear 23, which operates automatically, through chain 34, to correspondingly and simultaneously rotate the right gear 23.

Accordingly, the gears are simultaneously adjusted relative to their associated pull rods 22, in such manner as to change the vertical position of platen 10 relative to pull rods 22 when the press is in its fully-open position shown in FIG. 1. Such fully-open position is, as stated above, that which exists when there is no hydraulic pressure applied and the piston rods 28 (and thus pull rods 22) are in their uppermost positions due to the forces exerted by springs 21.

The positions of the parts, the sizes of the bushings 18, etc., are so regulated that there will always be sufficient stroke of the press.

It is important that the pull rods 22 not rotate during or after the adjustments effected by gears 23. To prevent such rotation, a bar 37 is extended between the upper ends of pull rods 22. Such bar has longitudinal slots therein which fit over flattened portions 38 at the upper ends of the pull rods. The relationships are such that the flattened portions 38 may not rotate relative to bar 37, because the slots in the bar are insufficiently large to permit any such rotation.

To be sure that the bar 37 is not lifted off the ends of the pull rods 22, except at the factory, suitable caps may be provided over the flattened portions, one such cap being shown at 39 at the left portions of FIGS. 1 and 2.

It is to be understood that the upper portion of the press, above platen 10, is preferably covered by a housing, not shown. The lower portion, below bed 11, is preferably housed by another unshown housing.

There has thus been described a small, inexpensive, light-weight press that can perform many functions. The press is made of standard parts, or easily-manufactured parts, and does not require special seals, cylinders, etc. It is practical, economical, and commercial. Each assembly of pins, pull rod, cylinder, gear and spacer may be mass-manufactured and then shipped elsewhere for mounting on the platen and bed, etc.

As an example, which is given by way of example only and not limitation, each guide pin 17 may have an outer diameter of 1.5 inch. The diameter of the bore 22*a* through each guide pin 17 is 7/8 inch. The diameter of each pull rod 22 is 0.5 inch. Such a press will generate at least five tons of pressure, when hydraulic pressure of sufficient magnitude is introduced into cylinders 27 from source 29. Accordingly, many punching, forming, braking, etc., processes may be performed. The rate of press operation is, for example, thirty strokes per minute.

It is to be understood that various changes may be made without departing from the scope of the invention. For example, the gears 23 may be specially manufactured and therefore directly mounted on the upper ends of bushings 18. In other words, the spacers 24 do not need to be separate parts. As another illustration, the interconnections between gears 23 may be provided in other ways, as by (for example) a rod and bevel gears.

The cost of the press may be further reduced by mounting pistons slidably and sealingly in bores 22*a*, such pistons being connected to and coaxial with pull rods 22. Wall means, having sealed central bores which slidably and sealingly receive rods 22, are then mounted in bores 22*a*, above the pistons, to form sealed chambers above the pistons. Fluid is then introduced into, and vented from, such chambers by conduits that extend upwardly through pins 17 and through the pistons.

The foregoing detailed description is to be clearly understood as given by way of illustration and example only, the spirit and scope of this invention being limited solely by the appended claims.

We claim:

1. A punch press, comprising:

(a) a platen and a bed disposed in parallel relationship to each other, (b) first and second guide pins projecting upwardly from said bed, said guide pins being perpendicular to said bed, said guide pins being spaced sufficiently far from each other to permit mounting of dies therebetween, each of said guide pins having a longitudinal bore therethrough, (c) bushings mounted slidably on the upper end portions of said guide pins, said bushings having upper portions extending above the upper ends of said guide pins and at least to said platen, (d) pull rods extending through said bores in said guide pins, (e) connector means to connect the upper ends of said pull rods to said platen, said connector means comprising threaded elements threadably associated with the upper ends of said pull rods, said threaded elements being seated on said platen, said threaded elements being adapted to be rotated relative to said pull rods to thereby adjust the position of said platen relative to said bed prior to injection of fluid into said cylinder, (f) helical compression springs mounted around said guide pins and seated between said bed and said bushings, (g) cylinders mounted at said bed, the pistons of said cylinders being connected to the lower ends of said pull rods, (h) means to inject fluid into said cylinders to cause them to shift their pistons downwardly, thus pulling downwardly on said pull rods and causing downward movement of said platen, (i) means to effect simultaneous and equal rotation of said threaded elements relative to their associated pull rods to thus effect uniform adjustment at each of said pull rods, whereby to prevent unbalance of forces in the press, and (j) means to prevent rotation of said pull rods during rotation of said threaded elements including a bar extended between said pull rods and having a noncircular opening at each of said pull rods, said noncircular openings mating with noncircular portions of the ends of said pull rods to prevent rotation.

2. The invention as claimed in claim 1, in which said threaded elements are gears, and in which means are provided to interconnect said gears to thus effect said simultaneous and equal rotation.

3. The invention as claimed in claim 2, in which said gears are sprocket gears, and in which said connector means comprises a chain connecting said sprocket gears.

4. The invention as claimed in claim 1, in which means are provided to effect stopping of the downward movement of said platen in response to striking of stop means provided on said guide pins.

5. The invention as claimed in claim 1, in which said cylinders (g) are mounted below said bed and have piston rods extended upwardly into said bores in said guide pins, said piston rods being connected to the lower ends of said pull rods.

6. The invention as claimed in claim 1, in which said guide pins extend upwardly through openings in said bed, in which said cylinders are separate cylinder elements mounted below the lower ends of said guide pins, the upper end of each such cylinder element seating on the underside of said bed adjacent the associated guide pin, and in which said bushings extend upwardly above the upper ends of said guide pins and into openings in said platen.

7. The invention as claimed in claim 6, in which a spacer is mounted around the upper end of each of said pull rods and seated on the upper surface of said platen, each such spacer having a collar portion extended downwardly into the associated bushing to effect centering of said spacer relative to said bushing, and in which gears are mounted in seated relationship on the upper surfaces of said spacers and threadedly associated with upper threaded end portions of said pull rods.

8. The invention as claimed in claim 7, in which connector means are provided to interconnect the gear at one of said pull rods with the gear at the other end of said pull rods, and which means are provided to prevent rotation of said pull rods during rotation of said gears.

* * * * *